US012025137B2

(12) United States Patent
Chavis et al.

(10) Patent No.: US 12,025,137 B2
(45) Date of Patent: Jul. 2, 2024

(54) WATER GULPING DETECTION

(71) Applicant: Franklin Electric Co., Inc., Fort Wayne, IN (US)

(72) Inventors: Adrian Chavis, Fort Wayne, IN (US); Kevin Michael Fox, New Haven, IN (US)

(73) Assignee: FRANKLIN ELECTRIC CO., INC., Fort Wayne, IN (US)

( * ) Notice: Subject to any disclaimer, the term of this patent is extended or adjusted under 35 U.S.C. 154(b) by 37 days.

(21) Appl. No.: 17/308,428

(22) Filed: May 5, 2021

(65) Prior Publication Data

US 2021/0348614 A1 Nov. 11, 2021

Related U.S. Application Data

(60) Provisional application No. 63/020,677, filed on May 6, 2020.

(51) Int. Cl.
*F04D 15/00* (2006.01)

(52) U.S. Cl.
CPC ..... *F04D 15/0077* (2013.01); *F04D 15/0088* (2013.01)

(58) Field of Classification Search
None
See application file for complete search history.

(56) References Cited

U.S. PATENT DOCUMENTS

2005/0074337 A1* 4/2005 Anderson ..... F04B 43/1253 417/44.11
2006/0245931 A1* 11/2006 Zeh ..... F04D 15/0236 417/44.1
2007/0154321 A1* 7/2007 Stiles, Jr. ..... F04B 49/02 417/44.1
2010/0080714 A1* 4/2010 Mehlhorn ..... F04B 49/065 417/44.11
2010/0275628 A1* 11/2010 Moseley ..... F04B 49/10 417/44.1

(Continued)

FOREIGN PATENT DOCUMENTS

WO WO-2019152959 A2 * 8/2019 ..... F04D 15/0066

OTHER PUBLICATIONS

Tavner, Ran and Crabtree, Condition Monitoring of Rotating Electrical Machines, section 5.5 (2020, The Institution of Engineering and Technology, 3rd Edition, pp. 110-111) (Year: 2020).*

*Primary Examiner* — Connor J Tremarche
*Assistant Examiner* — Geoffrey S Lee
(74) *Attorney, Agent, or Firm* — Faegre Drinker Biddle & Reath LLP

(57) ABSTRACT

A method to detect gulping in a pump driven by a motor drive to pump a liquid includes: determining a value of a work indicator corresponding to work performed by a pump pumping a liquid; comparing the value to a first threshold; changing a value of a tracking variable by a first amount if the value of the work indicator is below the threshold; changing the value of the tracking variable by a second amount if the value of the work indicator is above the threshold, wherein the first amount and the second amount have opposite signs; and determining that a gulping event occurred if an absolute value of the tracking variable is larger than an absolute value of a second threshold.

15 Claims, 4 Drawing Sheets

(56) References Cited

U.S. PATENT DOCUMENTS

| | | | | |
|---|---|---|---|---|
| 2011/0057590 | A1* | 3/2011 | Flanary | H02K 11/215 318/400.13 |
| 2011/0238013 | A1* | 9/2011 | Wang | A61M 5/16831 604/123 |
| 2014/0165703 | A1* | 6/2014 | Wilt | G01N 29/02 73/24.06 |
| 2019/0203724 | A1* | 7/2019 | Kuronuma | F04D 13/0666 |
| 2019/0393816 | A1* | 12/2019 | Chedygov | H02P 21/22 |
| 2020/0052642 | A1* | 2/2020 | Kuroki | H02P 29/60 |
| 2020/0362867 | A1* | 11/2020 | Fox | F04D 15/0066 |

* cited by examiner

WATER GULPING DETECTION

CROSS-REFERENCE TO RELATED APPLICATIONS

This application claims priority from and the benefit of U.S. Provisional Application No. 63/020,677, filed May 6, 2020, which is incorporated by reference herein in its entirety.

FIELD OF THE DISCLOSURE

A method to detect gulping in a pump driven by a motor drive to pump a liquid.

BACKGROUND OF THE DISCLOSURE

"Gulping" is a phenomenon that occurs when the water level at an inlet of a pump is reduced and the reduced water level allows air to enter the pump. Then, when the water level increases, the water pressure removes the air and pumping continues normally. The sequence may repeat. Due to the timing of the gulping events, traditional fault determination methods may fail to capture all instances of gulping.

A new method is needed to detect the gulping phenomenon and protect the pump.

SUMMARY

Aspects of the disclosure include a motor drive including processing instructions operable to implement a gulping detection method, a gulping detection method, and a software product including said processing instructions.

In a first aspect, a method to detect gulping includes determining a value of a work indicator, comparing the value to a first threshold, changing a value of a tracking variable by a first amount if the value of the work indicator is below the threshold, changing the value of the tracking variable by a second amount if the value of the work indicator is above the threshold, wherein the first amount and the second amount have opposite signs, and determining that a gulping event occurred if an absolute value of the tracking variable is larger than an absolute value of a second threshold.

The absolute values of the first and second amounts may be the same.

The second amount might be a fraction of the absolute value of the first amount. Thus, if the first amount equals 1, the second amount may range between 0 and −1. If the first amount equals −1, the second amount may range between 0 and +1.

The first and second amounts may be variable and based on a difference between the work indicator and the first threshold. For example, the first amount may have one value when the difference is small and a larger value when the difference is large.

The first and second amounts may vary proportionally to a difference between the work indicator and the first threshold.

The tracking variable may be an integral of the work indicator. The tracking variable may also have integration limits such that, for example, the integral does not grow when the difference exceeds an integration limit.

The absolute value of the first amount might be twice the absolute value of the second amount.

The work indicator might be based on a current, a power, a torque, or variations thereof, indicating an amount of work performed by a pump. The pump might be driven by an electric motor, and the current, power and torque might be determined based on operating conditions of a motor drive driving the electric motor. The motor drive might be a variable speed drive. The current might be the motor's current or a current of a DC-bus of the motor drive. The motor drive might be a line frequency motor drive, such as contactor or circuit breaker, with or without a soft-start circuit.

Power may be measured as a voltage and current of the DC-bus or based on instantaneous voltage output by the motor drive and current output by the motor drive.

Torque may be measured as a function of power and slip, or a difference between actual motor speed and commanded speed.

Determining a value of a work indicator might be performed on a periodic basis, such as every second, although the determination may be performed more or less frequently and the first and second amounts may be adjusted responsive to the frequency of the determination.

Although it is envisioned to perform the determining in a digital system in which the values are numbers, an analog circuit may also be used, for example an integrator comprised of operational amplifiers as is known in the art.

In a second aspect, a motor drive including processing instructions operable to implement a gulping detection method is provided. The motor drive includes an inverter and gulping detection logic operable for determining a value of a work indicator, comparing the value to a first threshold, changing a value of a tracking variable by a first amount if the value of the work indicator is below the threshold, changing the value of the tracking variable by a second amount if the value of the work indicator is above the threshold, wherein the first amount and the second amount have opposite signs, and determining that a fault occurred if an absolute value of the tracking variable is larger than an absolute value of a second threshold.

In one variation, the gulping detection logic is operable to determine a value of a work indicator, compare the value to a first threshold, increment a value of a tracking variable by a first amount if the value of the work indicator is below the threshold, decrement the value of the tracking variable by a second amount if the value of the work indicator is above the threshold, and determine that a fault occurred if the value of the tracking variable exceeds a second threshold.

In another variation, the gulping detection logic is operable to determine a value of a work indicator, compare the value to a first threshold, decrement a value of a tracking variable by a first amount if the value of the work indicator is below the threshold, increment the value of the tracking variable by a second amount if the value of the work indicator is above the threshold, and determine that a fault occurred if the value of the tracking variable exceeds a second threshold. In the present variation, the signs of the first and second amounts are the same.

The motor drive may include a voltage sensor and a current sensor, and the gulping detection logic may determine values of voltage and current with the voltage sensor and the current sensor. The gulping detection logic may determine values of the work indicator with the values of the voltage and current.

The work indicator may be implemented with a digital counter. The digital counter may be incremented and decremented at different rates based on whether the value of the work indicator is above or below the first threshold.

The work indicator may be implemented with a digital summer. The digital summer may add the first amount and or the second amount based on whether the value of the work indicator is above or below the first threshold.

In a third aspect, a software product operable to implement a gulping detection method is provided. The software product comprises processing instructions operable to determine a value of a work indicator, compare the value to a first threshold, increment a value of a tracking variable by a first amount if the value of the work indicator is below the threshold, decrement the value of the tracking variable by a second amount if the value of the work indicator is above the threshold, and determine that a fault occurred if the value of the tracking variable exceeds a second threshold.

The software product may be embedded in memory of a processor or in memory communicatively coupled with a processor.

The software product may be embedded in a system to program processors of motor drives or memories of motor drives.

The above-mentioned features of the first aspect of the disclosure may be implemented in the software product and the motor drive.

Certain embodiments of the present disclosure may include some, all, or none of the above advantages. One or more other technical advantages may be readily apparent to those skilled in the art from the figures, descriptions, and claims included herein. Moreover, while specific advantages have been enumerated above, various embodiments may include all, some or none of the enumerated advantages.

DESCRIPTION OF THE DRAWINGS

The features and advantages of the disclosure will become more readily appreciated as the same become better understood by reference to the following detailed description when taken in conjunction with the accompanying drawings, where.

Figure 1:
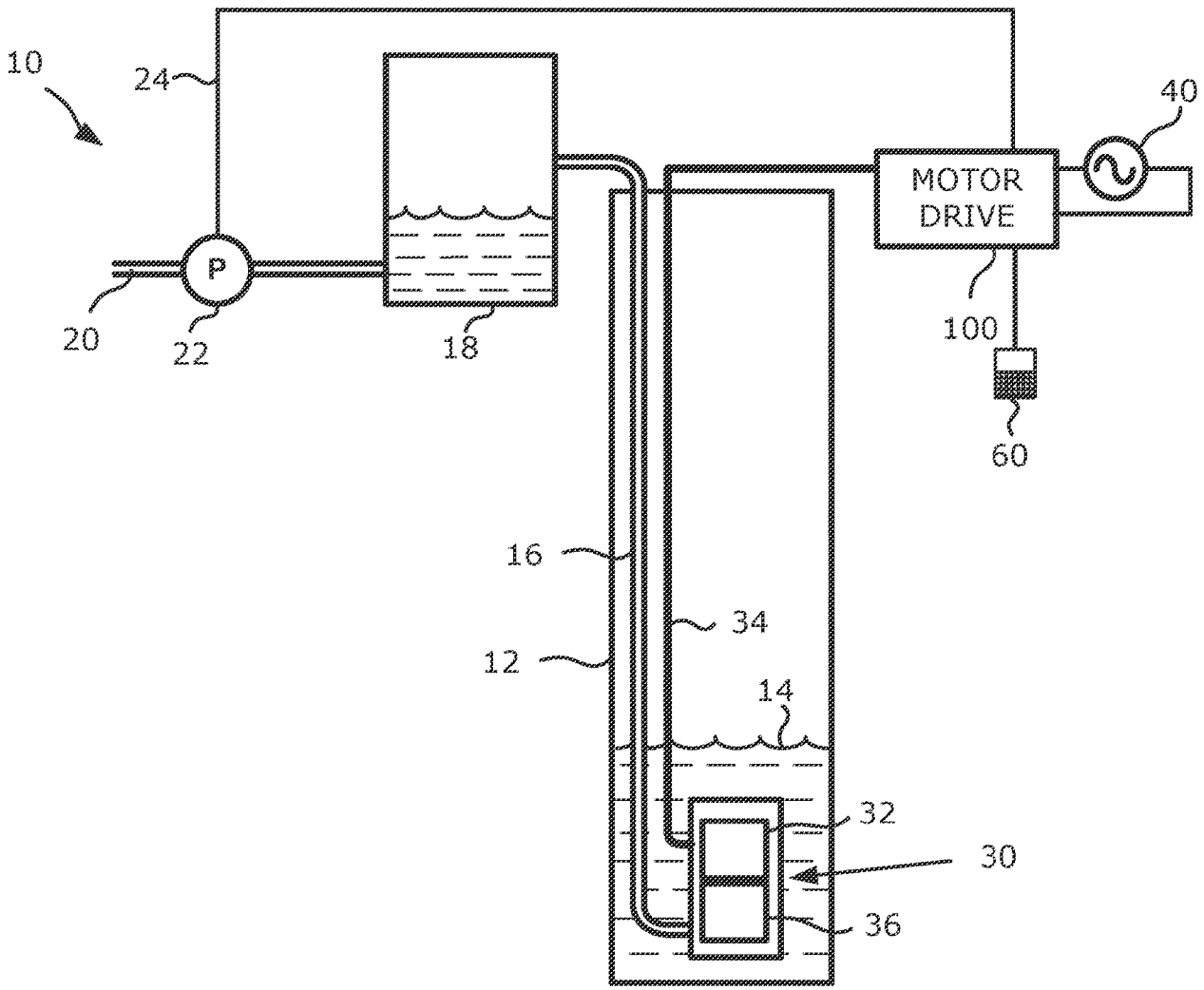
FIG. 1 is a schematic diagram of a water pumping system including a motor drive.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplifications set out herein illustrate embodiments of the disclosure, and such exemplifications are not to be construed as limiting the scope of the claims in any manner.

DETAILED DESCRIPTION

For the purposes of promoting an understanding of the principles of the disclosure, reference will now be made to the embodiments illustrated in the drawings, which are described below. The embodiments disclosed below are not intended to be exhaustive or limit the claims to the precise form disclosed in the following detailed description. Rather, the embodiments are chosen and described so that others skilled in the art may utilize their teachings. It will be understood that no limitation of the scope of the claims is thereby intended.

Except where a contrary intent is expressly stated, terms are used in their singular form for clarity and are intended to include their plural form.

The foregoing embodiments of the disclosure, and others, will now be described with reference to the figures. Referring to FIG. 1, a diagrammatic representation of a liquid supply or pump system 10 is disclosed. Example liquids include water, gasoline fuel, diesel fuel, petroleum, oil, sewage, and combinations of such liquids with gases and solids, such as water and coal-based methane gas. The liquid supply system comprises a reservoir 12 containing water 14 which is pumped by a pump unit 30 through a conduit 16, optionally via another reservoir 18, e.g. a pressure tank, to a conduit 20 of a closed system. A submersible or immersive pump unit 30 includes a pump 36 driven by a motor 32 which is powered by a motor drive 100 via power conductors 34. The size of reservoir 12, which is interposed between pump unit 30 and a pressure sensor or transducer 22, affects the response of the system. In one example, the motor drive 100 is a variable frequency drive and pump 36 is a centrifugal pump. Motor drive 100 may be referred to hereinafter as "the VFD". Power conductors 34 may comprise two or more wires to provide single or three phase power to motor 32.

During operation of the system, water 14 flows out of conduit 20. For example, the system may be a water system in a home, in which case water flows out of conduit 20 when a faucet is opened or an irrigation system is turned on. Constant pressure ensures the heads of the irrigation system spray at a constant distance from the head to provide even and predictable irrigation. Fluid characteristics including pressure may be monitored with the pressure sensor 22 disposed in conduit 20 to generate a pressure signal useful to maintain pressure about a setpoint. The pressure signal is provided via line 24 connecting the pressure sensor 22 and the motor drive 100. An exemplary input device 60 is also shown. Input device 60 is provided to receive, from a user, input parameters such as setpoints and schedules. Input device 60 may comprise a smart device wirelessly coupled to motor drive 100. Example smart devices include computers, smart phones and tablets. Reservoir 12 may be an aboveground or underground tank, a well casing, or any other reservoir containing water 14.

Figure 2:
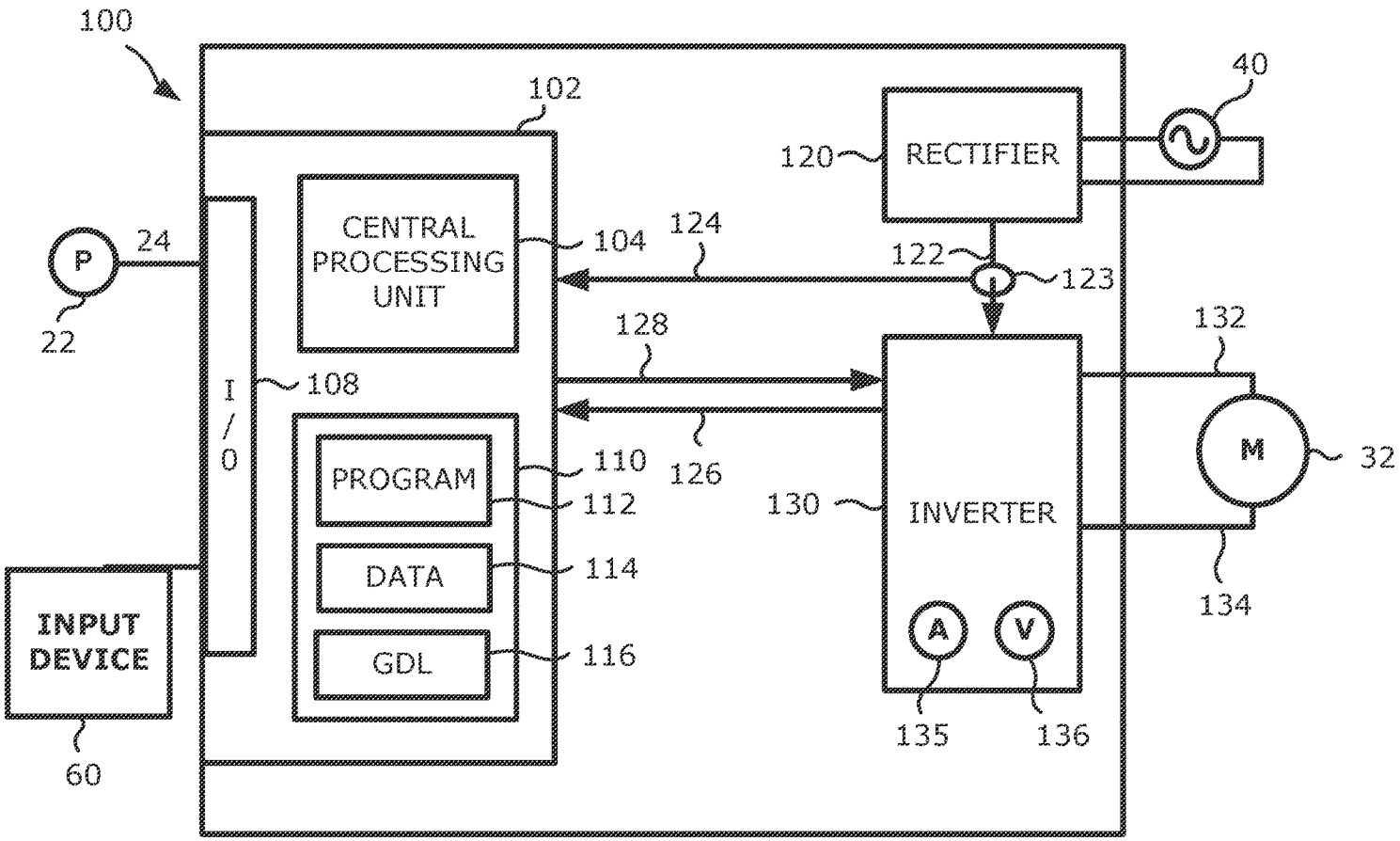
FIG. 2 is a schematic diagram of a motor drive.

FIG. 2 illustrates an embodiment of motor drive 100 comprising a processing device, illustratively controller 102, a rectifier 120 and an inverter 130. As shown, controller 102 includes a CPU 104 configured to access a memory device 110 and execute processing instructions from a program module, exemplified by program 112, based on data 114. Another example of a program module is shown as gulping detection logic (GDL) module 116. GDL module 116 is described in additional detail with reference to FIGS. 3 and 4. GDL module 116 may also be comprised in a hardware module communicatively coupled to CPU 102.

Techniques for generating motor voltages according to characteristics of a control signal are known in the art. In one example, a technique comprises storing values in a table corresponding to samples of an operating curve. The operating curve is typically a substantially straight line defining a volts-hertz relationship. When the speed control system determines a desired operating speed, which defines an operating frequency, the motor drive 100 looks up a voltage corresponding to the frequency. The motor drive 100 then generates a motor voltage based on the voltage and the frequency. In another example, a formula or a function embodying the operating curve characteristics is used by CPU 104 to generate the desired motor voltages.

Rectifier 120 is powered by a power source 40 and includes any rectification circuit well known in the art, e.g., a diode bridge, to convert alternating-current (AC) voltage supplied by power source 40 into direct-current (DC) voltage which it supplies to inverter 130. Inverter 130 receives DC power from rectifier 120 through a conductor 122 and converts the DC power into an AC motor power. Power source 40 may comprise a single phase two-wire supply, a single phase three-wire supply, or a three phase supply. A single phase two-wire supply is shown.

CPU 104 receives inputs through an I/O interface 108 and outputs a control signal over line 128 to inverter 130. In one example, the control signal, e.g. speed reference, is provided to a pulse-width-modulated (PWM) module having power switches and control logic which generates the appropriate gating signals for the power switches to convert the DC power supplied by rectifier 120 to the AC motor voltage suitable to drive the motor according to the control signal, provided to the motor via conductors 132, 134. Current drawn by inverter 130 from rectifier 120 is sensed by a current sensor 123 and a current signal is provided by current sensor 123 to CPU 104 by conductor 124. Motor voltage feedback can also be provided, for example through conductor 126 connecting inverter 130 and controller 102. Motor voltages may also be generated with other known or later developed drive topologies programmed in accordance with embodiments of the disclosure. A motor current sensor 135 and a motor voltage sensor 136 are also shown. Current sensor 135 and voltage sensor 136 may be any sensor known in the art, including for example a sensing resistor and a current transformer. The outputs of current sensor 135 and voltage sensor 136 may be multiplied by CPU 104 execute processing instructions to generate a power value representative of electrical power consumed by motor 32.

In a more general embodiment, the controller comprises control logic operable to generate the control signal. The term "logic" as used herein includes software and/or firmware executing on one or more programmable processors, application-specific integrated circuits, field-programmable gate arrays, digital signal processors, hardwired logic, or combinations thereof. Therefore, in accordance with the embodiments, various logic may be implemented in any appropriate fashion and would remain in accordance with the embodiments herein disclosed. A non-transitory machine-readable medium comprising logic can additionally be considered to be embodied within any tangible form of a computer-readable carrier, such as solid-state memory, magnetic disk, and optical disk containing an appropriate set of computer instructions and data structures that would cause a processor to carry out the techniques described herein. A non-transitory computer-readable medium, or memory, may include random access memory (RAM), read-only memory (ROM), erasable programmable read-only memory (e.g., EPROM, EEPROM, or Flash memory), or any other tangible medium capable of storing information.

Figure 3:
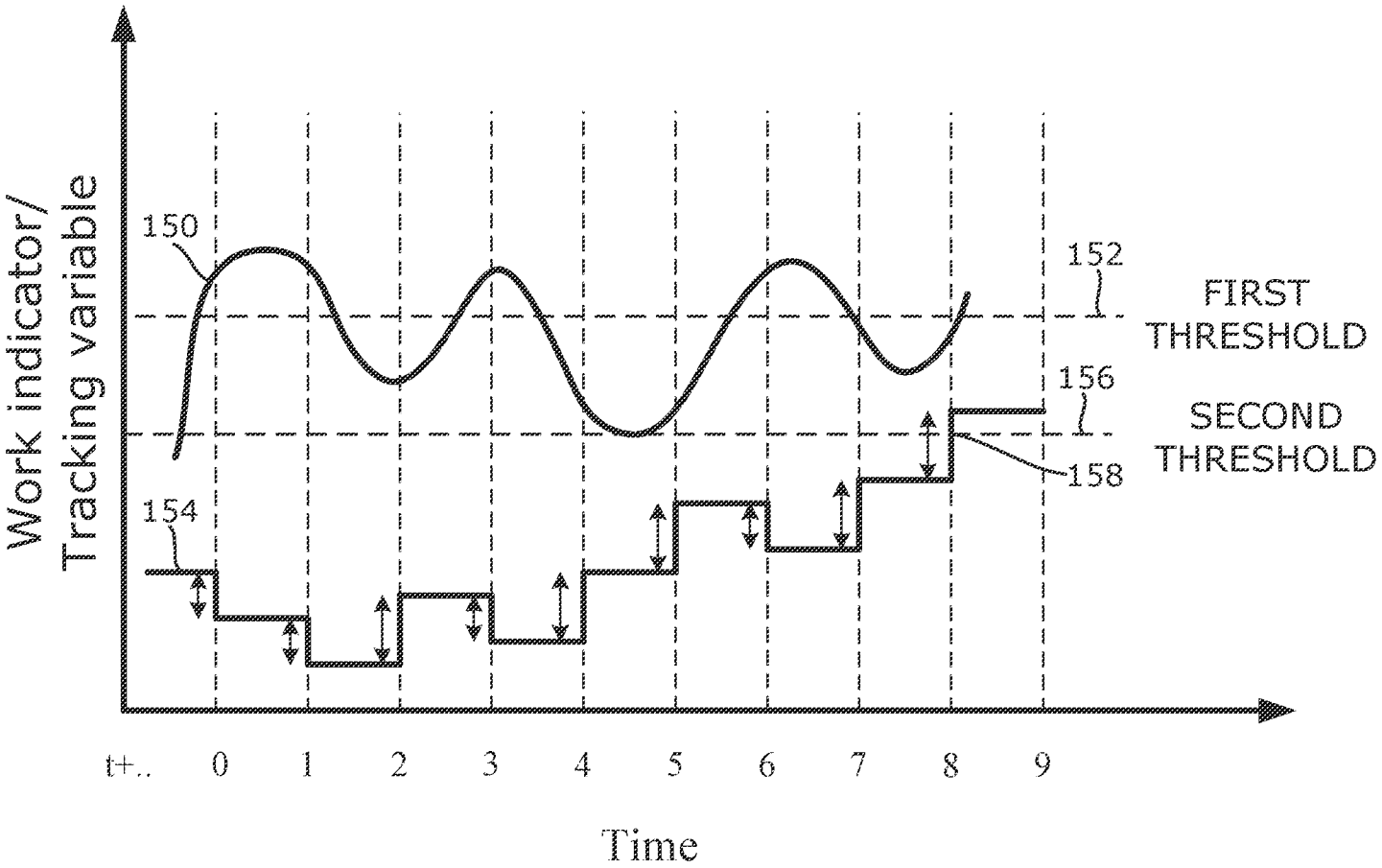
FIG. 3 is a graph of a work indicator and a tracking variable versus time.

FIG. 3 is a graph illustrating operation of an embodiment of the gulping detection method implemented by gulping detection logic. The graph includes a work indicator curve 150 representing values over time of a work indicator, described previously, for example power, current or torque. A work indicator could also be a pressure or flow value of the pump, since pressure and flow variations correlate with the gulping events. The graph also includes a tracking variable curve 154 representing values over time of a tracking variable, described previously. The graph also includes a first threshold 152 and a second threshold 156. At 158 the tracking variable value exceeds the second threshold and the GPL determines that a gulping event has been detected. The motor drive may shut-down in response to the detection of the gulping event.

In one example, values of work indicator curve 150 are measured periodically, indicated by vertical dashed lines. When the value is above the first threshold, the second amount is subtracted from the tracking variable, as indicated at t, t+1, t+3, and t+6. When the value is below the first threshold, the first amount is added from the tracking variable, as indicated at t+2, t+4, t+5, t+7, and t+8. The value of the tracking variable exceeds the second threshold at 156, corresponding to t+8, at which time the GDL determines that a gulping event occurred.

The graph shown in FIG. 3 is an example. Other graphs can be constructed to achieve an equivalent result. The first and second amounts, and the work indicator sampling frequency, can be adjusted to set a desired responsiveness to gulping and to compensate for variations in the system due to, for example, pump size, speed, and impeller characteristics.

Figure 4:
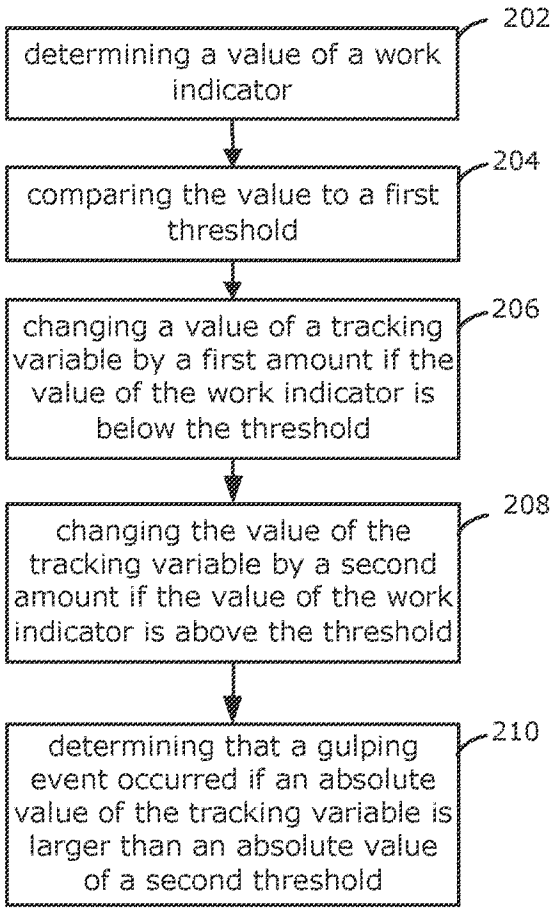
FIG. 4 is a block diagram of an embodiment of gulping detection method.

FIG. 4 is a flowchart of an embodiment of the gulping detection method. The method includes: determining a value of a work indicator, at 202, comparing the value to a first threshold, at 204, changing a value of a tracking variable by a first amount if the value of the work indicator is below the threshold, at 206, changing the value of the tracking variable by a second amount if the value of the work indicator is above the threshold, at 208, and determining that a gulping event occurred if an absolute value of the tracking variable is larger than an absolute value of a second threshold, at 210.

The absolute values of the first and second amounts may be the same.

The second amount might be a fraction of the absolute value of the first amount. Thus, if the first amount equals 1, the second amount may range between 0 and −1. If the first amount equals −1, the second amount may range between 0 and +1.

The first and second amounts may be variable and based on a difference between the work indicator and the first threshold. For example, the first amount may have one value when the difference is small and a larger value when the difference is large. A threshold may be set to determine when the difference is large, and the difference may be deemed small if it is less than the threshold.

The first and second amounts may vary proportionally to a difference between the work indicator and the first threshold. Thus, instead of just a small and large values for the first amount, the first amount may have a multitude of values.

The tracking variable may be an integral of the work indicator. The tracking variable may also have integration limits such that, for example, the integral does not grow when the difference exceeds an integration limit.

The absolute value of the first amount might be twice the absolute value of the second amount.

The work indicator might be based on a current, a power, a torque, or variations thereof, indicating an amount of work performed by a pump. The pump might be driven by an electric motor, and the current, power and torque might be determined based on operating conditions of a motor drive driving the electric motor. The motor drive might be a variable speed drive. The current might be the motor's current or a current of a DC-bus of the motor drive.

Power may be measured as a voltage and current of the DC-bus or based on instantaneous voltage output by the motor drive and current output by the motor drive.

Torque may be measured as a function of power and slip, or a difference between actual motor speed and commanded speed.

Determining a value of a work indicator might be performed on a periodic basis, such as every second, although the determination may be performed more or less frequently and the first and second amounts may be adjusted responsive to the frequency of the determination.

Although it is envisioned to perform the determining in a digital system in which the values are numbers, an analog circuit may also be used, for example an integrator comprised of operational amplifiers as is known in the art.

In a second aspect, a motor drive including processing instructions operable to implement a gulping detection method is provided. The motor drive includes an inverter and gulping detection logic operable for determining a value of a work indicator, comparing the value to a first threshold, changing a value of a tracking variable by a first amount if the value of the work indicator is below the threshold, changing the value of the tracking variable by a second amount if the value of the work indicator is above the threshold, wherein the first amount and the second amount have opposite signs, and determining that a fault occurred if an absolute value of the tracking variable is larger than an absolute value of a second threshold. In the present embodiment a hysteresis range may be provided about the first threshold, such that small fluctuations about the first threshold, within the hysteresis range, do not generate changes to the tracking variable.

In one variation, the gulping detection logic is operable to determine a value of a work indicator, compare the value to a first threshold, increment a value of a tracking variable by a first amount if the value of the work indicator is below the threshold, decrement the value of the tracking variable by a second amount if the value of the work indicator is above the threshold, and determine that a fault occurred if the value of the tracking variable exceeds a second threshold. In the present variation a hysteresis range may be provided about the first threshold, such that small fluctuations about the first threshold do not generate an inordinate number of changes to the tracking variable. If the first threshold is, for example, 2.0, the hysteresis might be a range between 1.9 and 2.1, so that the tracking variable is incremented if the value of the work indicator is below 1.9 and decremented if the value of the work indicator is above 2.1, but no changes are made if the work indicator is within the hysteresis range.

In another variation, the gulping detection logic is operable to determine a value of a work indicator, compare the value to a first threshold, decrement a value of a tracking variable by a first amount if the value of the work indicator is below the threshold, increment the value of the tracking variable by a second amount if the value of the work indicator is above the threshold, and determine that a fault occurred if the value of the tracking variable exceeds a second threshold. In the present variation the first and the second amounts have the same sign. In the present variation a hysteresis range may be provided about the first threshold, such that small fluctuations about the first threshold, within the hysteresis range, do not generate changes to the tracking variable.

The motor drive may include a voltage sensor, e.g. 136, and a current sensor, e.g. 123, 135, and the gulping detection logic may determine values of voltage and current with the voltage sensor and the current sensor. The gulping detection logic may determine values of the work indicator with the values of the voltage and current. The current sensor may be located within the motor drive or electrically coupled to it but located outside the motor drive.

The work indicator may be implemented with a digital counter. The digital counter may be incremented and decremented at different rates based on whether the value of the work indicator is above or below the first threshold. The digital counter may be an algorithm executable by a processor or CPU to count up/down. The digital counter may also be a circuit, for example a clocked shift register or a counter integrated circuit.

The work indicator may be implemented with a digital summer. The digital summer may add the first amount or the second amount based on whether the value of the work indicator is above or below the first threshold. The digital summer may be an algorithm executable by a processor or CPU to calculate the sum. The digital summer may also be a circuit, for example a clocked shift register.

In a third aspect, a software product operable to implement a gulping detection method is provided. The software product comprises processing instructions operable to determine a value of a work indicator, compare the value to a first threshold, increment a value of a tracking variable by a first amount if the value of the work indicator is below the threshold, decrement the value of the tracking variable by a second amount if the value of the work indicator is above the threshold, and determine that a fault occurred if the value of the tracking variable exceeds a second threshold.

The software product may be embedded in memory of a processor or in memory communicatively coupled with a processor.

The software product may be embedded in a system to program processors of motor drives or memories of motor drives.

The above-mentioned features of the first aspect of the disclosure may be implemented in the software product and the motor drive.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method to detect gulping includes:

driving, with a motor drive, a motor mechanically coupled to a pump;

receiving, by a controller, a signal from at least one of a power sensor, a current sensor, a torque sensor, a voltage sensor, a pressure sensor and a flow sensor;

determining, by gulping control logic of the controller from the signal, a value of a work indicator corresponding to work performed by the pump;

comparing, by the gulping control logic, the value of the work indicator to a first threshold;

changing, by the gulping control logic, a value of a tracking variable by a first amount if the value of the work indicator is below the first threshold, wherein the change of the first amount is variable based on a difference between the work indicator and the first threshold;

changing, by the gulping control logic, the value of the tracking variable by a second amount if the value of the work indicator is above the first threshold, wherein the first amount and the second amount have opposite signs;

determining, by the gulping control logic, that a gulping event occurred if an absolute value of the tracking variable is larger than an absolute value of a second threshold; and in response to determining that a gulping event occurred, controlling, by the controller, operation of the motor drive.

2. The method of claim 1, wherein an absolute value of the first amount is equal to an absolute value of the second amount.

3. The method of claim 1, wherein an absolute value of the second amount is a fraction of an absolute value of the first amount.

4. The method of claim 1, wherein an absolute value of the first amount is a fraction of an absolute value of the second amount.

5. The method of claim 1, wherein the first amount varies proportionally to the difference.

6. The method of claim 1, wherein the work indicator is based on a power drawn by the motor.

7. The method of claim 6, wherein a power drawn by the motor is determined by sensing a voltage and sensing a current with a current transformer.

8. The method of claim 6, wherein a power drawn by the motor is determined by sensing a voltage and a current within a variable speed drive.

9. The method of claim 1, wherein the motor drive is a variable speed drive.

10. The method of claim 1, wherein the motor drive is a contactor, or a circuit breaker which, when engaged, supplies a line voltage to the motor.

11. The method of claim 1, wherein determining the value of the work indicator is performed periodically.

12. The method of claim 1, wherein comparing the value of the work indicator to the first threshold comprises comparing the value of the work indicator to a hysteresis range about the first threshold, wherein changing the value of the tracking variable by the first amount if the value of the work indicator is below the first threshold comprises changing the tracking variable if the value of the work indicator is below the hysteresis range, and wherein changing the value of the tracking variable by the second amount if the value of the work indicator is above the first threshold comprises changing the tracking variable if the value of the work indicator is above the hysteresis range.

13. A motor drive operable to drive a motor coupled to a pump to pump a liquid, the motor drive comprising:

an inverter generating a motor voltage;

a voltage sensor to determine a voltage;

a current sensor to determine a current; and a controller including gulping control logic comprising processing instructions operable to:

determine a value of a work indicator corresponding to work performed by the pump;

compare the value to a first threshold;

change a value of a tracking variable by a first amount if the value of the work indicator is below the first threshold, wherein the change of the first amount is variable based on a difference between the work indicator and the first threshold;

change the value of the tracking variable by a second amount if the value of the work indicator is above the first threshold, wherein the first amount and the second amount have opposite signs;

determine that a gulping event occurred if an absolute value of the tracking variable is larger than an absolute value of a second threshold; and in response to determining that a gulping event occurred, control operation of the motor.

14. The motor drive of claim 13, wherein determining the value of the work indicator is performed periodically, wherein the work indicator is based on a power drawn by the motor, and wherein determining the value of the work indicator is performed periodically.

15. The motor drive of claim 13, wherein comparing the value to a first threshold comprises comparing the value to a hysteresis range about the first threshold, wherein changing the value of the tracking variable by the first amount if the value of the work indicator is below the first threshold comprises changing the tracking variable if the value of the work indicator is below the hysteresis range, and wherein changing the value of the tracking variable by the second amount if the value of the work indicator is above the first threshold comprises changing the tracking variable if the value of the work indicator is above the hysteresis range.

* * * * *